US005890433A

United States Patent [19]

Wicks

[11] Patent Number: 5,890,433

[45] **Date of Patent: *Apr. 6, 1999**

[54] INTERMODAL VEHICLE FOR FORMING TRAIN OF TRAILERS

[75] Inventor: Harry O. Wicks, El Paso, Tex.

[73] Assignee: RailRunner Systems, Inc., Ga.

[ * ] Notice: The term of this patent shall not extend beyond the expiration date of Pat. No. 5,291,835.

[21] Appl. No.: 889,080

[22] Filed: Jul. 7, 1997

Related U.S. Application Data

[63] Continuation of Ser. No. 525,713, Sep. 22, 1995, abandoned, which is a continuation-in-part of Ser. No. 37,040, Mar. 25, 1993, Pat. No. 5,291,835.

[51] Int. Cl.[6] ..... B61F 3/12

[52] U.S. Cl. ..... 105/4.2; 105/4.4; 105/159; 410/53; 213/75 R

[58] Field of Search ..... 105/4.1, 4.2, 4.3, 105/4.4, 159, 199.1, 199.2, 215.2; 410/53, 56, 57; 213/75 R

[56] References Cited

U.S. PATENT DOCUMENTS

| | | | |
|---|---|---|---|
| 4,202,276 | 5/1980 | Browne et al. | 105/215.2 |
| 4,547,107 | 10/1985 | Krause . | |
| 4,665,834 | 5/1987 | Van Iperen | 105/4.1 |
| 4,753,174 | 6/1988 | Berg et al. | 105/226 |
| 4,817,536 | 4/1989 | Cripe et al. | 105/182.1 |
| 4,955,144 | 9/1990 | Lienard et al. | 105/4.2 |
| 5,009,169 | 4/1991 | Viens | 105/4.1 |
| 5,020,445 | 6/1991 | Adams, Jr. | 105/4.1 |
| 5,040,466 | 8/1991 | Wicks et al. | 410/53 |
| 5,107,772 | 4/1992 | Viens | 105/4.2 |
| 5,152,228 | 10/1992 | Donkim . | |
| 5,199,359 | 4/1993 | Bedard | 105/168 |

FOREIGN PATENT DOCUMENTS

| | | |
|---|---|---|
| 205272 | 10/1979 | Germany . |
| 47672 | 2/1989 | Japan . |
| 2150900 | 7/1985 | United Kingdom . |

*Primary Examiner*—S. Joseph Morano
*Attorney, Agent, or Firm*—John C. Thompson

[57] ABSTRACT

A retractable intermodal vehicle (10) for supporting and connecting modified semitrailers (11) end-to-end to form a train of trailers capable of being operated on a railroad track (172); the semitrailers also able to be operated on a highway as regular semitrailers. In the preferred embodiment, the intermodal vehicle (10) is comprised of two lower frames (12), with a wheel/axle assembly (18) mounted to each, and each pivoted from and supporting a single upper frame assembly (14), the pivoting of these lower frames providing a limited steering of the rail axles relative to the upper frame. Inflatable air springs (22) are mounted between the lower frames (12) and upper frames (14) to allow each upper frame to be raised and lowered. The upper frame assemblies include a gravity load carrying structure (140) for supporting one end of a superimposed trailer, a coupler body (104), each containing a coupler tongue (116), the tongue being arranged to enter a complimentary coupler tongue receiving socket (120) at either end of the superimposed trailer; and an upwardly movable coupling pin (134), each pin capable of being raised to enter concentric apertures in a coupler tongue and an a complimentary trailer mounted socket to effect a coupling between these elements, and each pin being capable of being lowered to permit the withdrawal of the coupler tongue from the trailer socket.

22 Claims, 14 Drawing Sheets

INTERMODAL VEHICLE FOR FORMING TRAIN OF TRAILERS

CROSS REFERENCE TO RELATED APPLICATIONS

This application is a continuation of U.S. application Ser. No. 08/525,713, filed Sep. 22, 1995, now abandoned, which is a national filing of international application no. PCT/US94/02212, international filing date of Mar. 1, 1994, which is in turn a continuation-in-part of U.S. patent application Ser. No. 08/037,040, filed Mar. 25, 1993, now U.S. Pat. No. 5,291,835.

TECHNICAL FIELD

This invention deals with improvements in detachable intermodal rail adapting vehicles such as that shown in U.S. Pat. Nos. 5,040,466, 4,955,144 and 5,107,772 which may be used for forming a track supported train of highway trailers.

BACKGROUND OF THE INVENTION

The prior art describes methods and apparatus whereby highway trailers can be assembled into a train of rail cars by removably attaching the highway trailers to rail trucks (or bogies) with wheels appropriate to rail travel; the rail trucks being detached when the trailers are to be used as normal highway units.

In the prior art of U.S. Pat. No. 5,040,466, the coupling means between the trailers when used in the rail mode is of a style which includes a forward projecting (male) coupling tongue at the front of each trailer and a complimentary (female) socket at the rear of each trailer, together with a vertical pin passing through both the tongue and the socket to effect a coupling between them. In this prior art, a standard three-piece rail truck is surmounted by an adapter pedestal unit. The adapter pedestal unit is mounted within the center of the rail truck bolster in the same way that corresponding elements of a rail car would be mounted. That is, it has a circular flat center plate at its lower surface, with the center plate riding within the central "bowl" which is part of the rail truck bolster. It thus has the ability to rotate and rock as required by the motions of the car traveling on the track. The rail truck is equipped with normal coil springs which are able to deflect as required by the superimposed load. In order to mount the railtruck/adapter combination beneath the rear of a highway trailer for use on the rails it is necessary that the rear of the trailer be raised enough for the insertion of the railtruck/adapter unit. Additionally, it is also necessary that the adapter be high enough to ensure that once the loaded trailer is placed upon it, the highway wheels of the trailer will not touch the railroad track when the rail truck springs deflect under load. The usual method for raising the trailer to mount it upon the railtruck/adapter is by the use of an air-spring highway suspension on the trailer. This trailer suspension system, such as that manufactured by Nu-Way, Granning or Fruehauf, is customarily arranged to allow for the injection of excess air into the springs; the excess air causing the rear of a trailer so equipped to be lifted above its normal highway operating height to allow the railtruck/adapter unit to be placed beneath it. This air-spring highway suspension unit also has the ability to retract its axles still further once the railtruck/adapter unit is in place, thus raising the highway wheels clear of the tracks. Other methods for raising the trailers are also used acceptably. For example, it is also practical to simply lift the rear of the trailer by external or internal mechanical or hydraulic means, or by the use of a ramp for the trailer wheels. Placing the railtruck/adapter unit in a depressed track or lowering it with a lift table will also permit the trailer to be backed over it.

In the prior art of Pat. No. 5,107,772, a special rail truck is described. This special rail truck is comprised of a rail-wheel mounted chassis and a frame mounted above this chassis. This frame has attached to it, two "fifth wheel" units such as those normally found on a conventional highway tractor used for pulling semi-trailers. Trailers used with this rail truck are fitted with vertical, downward-projecting kingpins; one at each end of the trailers. In use, the trailers are backed over the fifth wheel units so that the kingpins enter the apertures of the fifth wheels. The rail wheels of this special rail truck are air-sprung, but the rail wheels are not steerable along the railroad track. It has been mathematically proved that the kingpin/fifth-wheel combination above described does not have sufficient strength to pull safely more than (perhaps) six loaded trailers at best. This is in part because the kingpin is in a single-shear arrangement. This inadequacy of kingpin strength is made up for by the use of intermediate traction units interspersed along the train, as shown in U.S. Pat. No. 5,107,772 and further in U.S. Pat. No. 5,009,169.

Another patent which discloses a rail truck which is adapted to support one end of each of two adjacent highway trailers is GB 2,150,900. A lifting coupling is at each end of the rail truck, the lifting coupling being provided with a load bearing surface and a pivot pin, the pivot pin being received within a suitable socket at an end of the highway trailer. This construction also has the disadvantage in that only a few trailers can be pulled because the pivot pin is also in single shear arrangement.

U.S. Pat. No. 4,955,144 also describes an intermodal rail truck unit which is detachable from specially-constructed trailers. The rail truck unit is equipped with two transverse bolsters, each of which is of a width to receive and support either end of a semitrailer or ISO container; the trailers or containers being attached to the aforesaid transverse bolsters by vertically-oriented, upwardly projecting twist-lock fittings near the outer ends of the bolsters, and similar to those customarily used in the attachment of ISO containers to each other and to ships or railroad cars transporting them. These twist-lock fittings are in a single-shear arrangement with respect to the tailer supporting bolsters. As in the case of the kingpins used in U.S. Pat. No. 5,107,772 described above, this single shear arrangement can be mathematically proved to be of insufficient strength to pull a train safely. U.S. Pat. No. 4,955,144 further describes the rail trucks used with this system as having a "rigid chassis." A rail truck having a rigid chassis is incapable of providing any steering of the individual rail axles. Additionally, the patent describes a train makeup and breakup procedure wherein the trailers and/or containers are lifted by an overhead crane into position atop the rail truck bolsters, over the upwardly-projecting twist-lock fittings located near the ends of the transverse trailer support bolsters. No procedure for train makeup or breakup other than lifting the trailers is described.

In all of the above prior art, disadvantages can be identified. For example, the requirement that in some prior art designs the rear of the trailers must be lifted or that the railtruck/adapters must be lowered for attachment beneath the trailers requires equipment which adds weight to the trailer, as does the inclusion of a coupler tongue and a coupler socket as part of the trailer structure. The use of fittings such as kingpins, pivot pins, or twist-locks for pulling a train of rail cars is not a structurally sound practice. Further, it is highly desirable that modern rail trucks have a capability for limited axle steering in order that they can perform more safely on poor tracks and at higher speeds on good tracks.

OBJECTS AND SUMMARY OF THE INVENTION

It is an object of the present invention to provide highway trailers and intermodal vehicles which can be assembled together to permit a long train to be drawn without danger of coupler rupture, the main frame of each of the highway trailers being provided with fore-and-aft extending leading and trailing coupler sockets, and wherein each of the intermodal vehicles has fore-and-aft extending coupler tongues which may be received within coupler sockets of adjacent highway trailers, the tongues being secured within the sockets by coupling pins carried by the intermodal vehicle and movable in a vertical direction through vertically aligned apertures.

It is a further object of the present invention to provide an intermodal vehicle of the type set forth above wherein the connection of the intermodal vehicle to the highway trailer is facilitated by mounting the coupler tongue in such a manner that the entire tongue is shiftable from side-to-side and is also shiftable vertically.

It is yet another object of the present invention to provide an intermodal vehicle for use in forming a train of the type set forth above wherein the rail wheels of the intermodal vehicle are steerable and wherein the means for shifting the coupler tongue vertically is an air spring which acts as a restoring force upon the steerable wheels.

Another object of the present invention is to provide a novel transition assembly which will permit the intermodal vehicle of this invention to be coupled to couplers carried by other vehicles.

It is yet another object of the present invention to provide load sensing brakes for the novel intermodal vehicles of this invention.

The foregoing objects and other objects and advantages of the present invention will become more apparent after a consideration of the following detailed description taken in conjunction with the accompanying drawings in which a preferred form of the present invention is illustrated.

DETAILED DESCRIPTION

Figure 1:
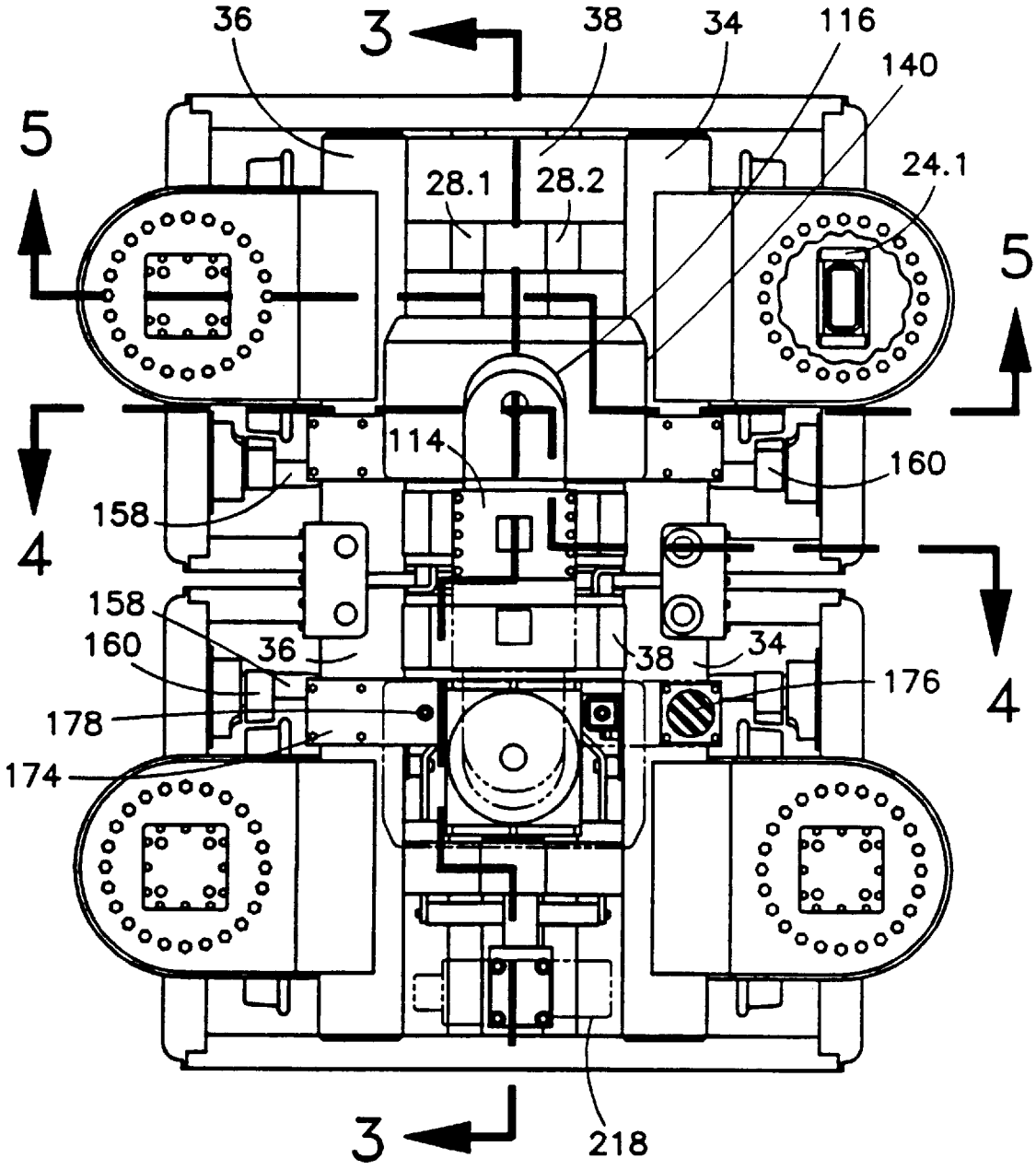
FIG. 1 is a plan view of the retractable intermodal vehicle of this invention.

The drawings disclose a novel retractable intermodal vehicle, which is indicated generally at 10, which is detachable from a specially-modified trailer, which is indicated generally at 11. The trailer can be used alternatively as a normal highway trailer pulled over the road by a standard highway tractor or as a part of a train of trailers coupled together to form a railroad train when mounted atop the intermodal rail vehicles of the type herein described. The trailers may be of any body type such as van, dump trailer, flatbed, container chassis, or any other. In the following text, right and left will refer to the positions as shown in FIG. 1, and leading and trailing will refer to the positions shown in FIGS. 2, 16, and 20, with the portion to the right being the leading portion, and the portion to the left being the trailing portion.

The major components comprising the retractable intermodal vehicle 10 are a pair of leading and trailing lower frames, each being indicated generally at 12, a pair of upper lifting frames, each being indicated generally at 14, and a pair of trailer support heads, each being indicated generally at 16, each of the trailer support heads being carried by an associated upper lifting frame 14. The retractable intermodal vehicle also includes a pair of leading and trailing rail axle/wheel assemblies of conventional design which are indicated generally at 18 and associated brake assemblies 20. Spring means extend between each of the upper lifting frames 14 and the lower frames 12, the principal component of the spring means being four air springs 22. As can best be seen from FIG. 16 there is an air spring between the right and left sides of the leading and trailing upper and lower frames 14, 12, respectively.

Each of the lower frames 12 include a pair of side frame assemblies 24, a cross bar 26, a steering arm assembly consisting of a pair of parallel longitudinally extending tubes 28.1 and 28.2, and a tie bar 30. The rail axle/wheel assembly 18 for each of the lower frames 12 is connected to the side frame assemblies 24 via rail wheel bearing supports 32.

Each upper lifting frame 14 is comprised of right and left longitudinal tubes 34, 36, and a leading transverse square tube 38. The leading upper frame also includes a trailing transverse square tube 40 (FIG. 3), this tube being omitted in the trailing upper frame 14. The tubes are welded together to form a rectangular airtight reservoir. The tubes 34–40 on the leading upper frame form a reservoir for the air springs 22, and the tubes 34–38 on the trailing upper frame form reservoirs for the air brakes associated with each retractable intermodal vehicle. The upper frames 14 also include transversely extending plates 42, 44 and cross bars 46, 48 which extend between the longitudinal side tubes 34, 36. The trailing cross tube 40 of the leading upper frame 14 has its top leading corner cut out for the reception of bar 48 which is welded thereto in an air tight manner. Similarly, the leading cross tube 38 of the trailing upper frame has its top trailing corner cut out for the associated bar 48, which is also welded thereto in an air tight manner. Upper spring mounting plate assemblies 50 are secured to the longitudinal side tubes 34, 36 and extend to the sides.

The spring means are generally disposed above each bearing support 32. To this end, a circular spring mounted plate or member 52 (FIG. 2) is mounted on top of each side frame assembly 24, the member 52 acting as a spring mounting plate. Extending through the center of each plate 52 is a square tubular portion 24.1, of the associated side frame assembly. Telescopically received within each square tubular portion is a side frame strut or column 54, best shown in FIG. 5. The exterior sides of the strut 54 are provided with suitable linear bearings, such as strips of plastic 56. Mounted on the top of each side frame column 54 is a mounting plate 58. A spring or shear mount 60 connects each mounting plate 58 to an associated mounting plate 50 of the upper lifting frame 14 by conventional fastening means such as threaded fasteners. The shear mounts are constructed as a sandwich of rubber bonded between two parallel metal plates. They serve to stabilize the air springs 22 which are disposed about each side frame column 54. Thus, when the shear mounts 60 are flexed or "sheared" to the side, they have a tendency to return to their original shape. Each shear mount 60 will be wholly within the associated air spring 22.

Figure 5:
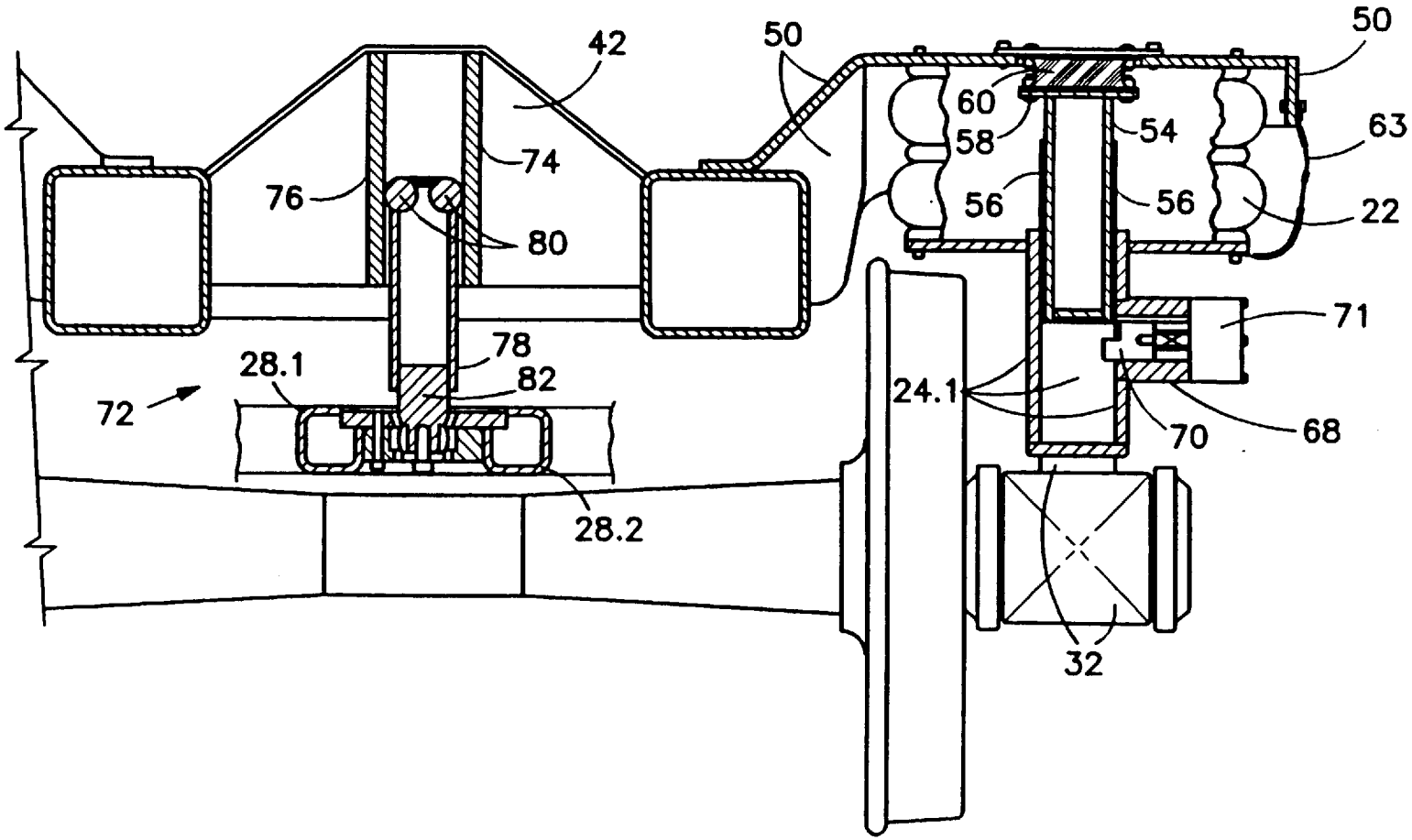
FIG. 5 is a partial cross-section of the steering link taken along view line 5—5 in FIG. 1, parts also being eliminated in this view for purposes of clarity.

The air springs are of a type manufactured by Firestone Industrial Products Company of Nobleville, Ind., U.S.A. under the tradename AIRAIL SPRING. The air spring 22, when partially extended, for example 2.5 cm (one inch) below its maximum height as shown in FIG. 5, will act as a spring. When the upper lifting frame is in its lowered position shown to the left of the centerline in FIG. 2, the addition of compressed air to the air springs will cause the air springs to raise the lifting frame thereby raising a trailer which may be on it, and at the same time providing a springing means for the trailer when traveling on the railroad track. Thus, when compressed air is introduced into the air springs, the upper lifting frame 14 can be raised to a spring height of approximately 26.5 cm (10.5 inches) and when the air is evacuated from the air springs, the lifting frame will lower to a spring height of approximately 8.25 cm (3.25 inches).

Four height control valves 62, one for each air spring, are provided to control and regulate the height of the air springs. The valves 62 are manufactured by Neway Corporation of Muskegon, Mich., and maintain the operating height of the air springs by adding or venting air from the springs. The valves are installed in accordance with the "Engineering Manual and Design Guide", No. 030 DKM 89, published by Firestone Industrial Products Company, Noblesville, Ind., the manufacturer of the air springs. When trailers are mounted on the trailer support heads 16, the valves 62 cause the heads to be raised until the springs 22 are approximately 2.5 cm (one inch) below their maximum safe operating height. Springs 22 are restrained from exceeding their maximum safe operating height by cables or chains 63.

Four spring dampers 64 are provided to prevent excessive spring action. Each damper is attached at its lower end to one of the side frames 24 and at its upper end to the upper lifting frame 14 by brackets 66 which extend from the upper spring mounting plate assembly 50 as can best be seen in FIG. 2.

With reference now to FIG. 5, for purposes of safety in the case of loss of air from any of the air spring 22, safety locks 68 are provided on each of the side frames 24. These locks consist of a spring-loaded pin 70, normally in the extended position. This pin is spaced below and away from the lower surface of the associated sliding column 54 when the air spring 22 is in the filled (running) position; that is, when the trailer is operating over the rails. Should a loss of air occur in one of the air springs, the column 54 will drop and the weight of the superimposed trailer will be carried by the safety lock pin 70 until the train can be brought to a halt and repairs to the spring made. For lowering the intermodal vehicle in order to attach or detach it from the trailer, the safety pin 70 is retracted by air cylinder 71.

Figure 9:
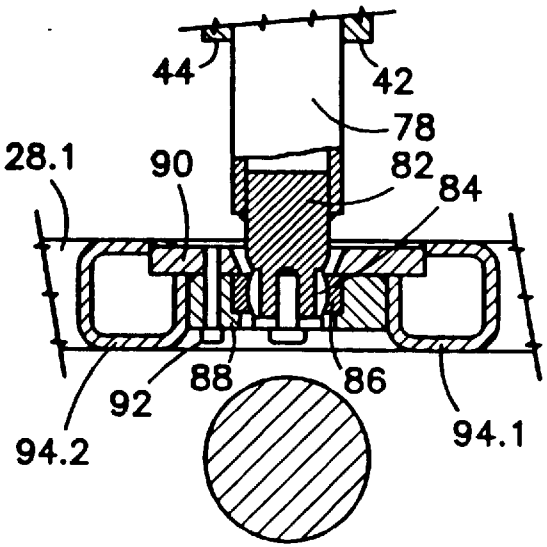
FIG. 9 is an enlarged view of the area indicated generally at 9 in FIG. 3.

Steering means, which are indicated generally at 72, are provided for steering each of the lower frames 12 relative to the associated upper frame 14. To this end, as can best be seen from FIGS. 3, 5, and 9, the steering means extend between the cross plates 40, 42 and the steering arm tubes 28.1 and 28.2. To this end, longitudinally extending plates 74, 76 are welded or otherwise rigidly secured between the cross plates 42, 44 to form a square tube. A tubular member 78 has its upper end portion disposed within the square tube formed by plates 42, 44, 74 and 76, and is adapted to move vertically therein. Round bars 80, which are welded to the upper end of the tubular member 78, allow the tubular member to tilt in a transverse direction as required during the rail operation of the retractable intermodal vehicle. A ball mounting member 82 is secured to the lower end of the tubular member 78 for the purposes of carrying a ball 84 which is part of a ball assembly. The ball 84 is mounted within a race 86 which is in turn held in place by a clamping ring 88 which is secured to an upper plate 90 by screws 92, the upper plate in turn being welded to cut outs in the steering arm tubes 28.1 and 28.2 as well as to transversely extending tubes 94.1 and 94.2 which extend between the steering arm tubes 28.1 and 28.2. The ball assembly may be of a type manufactured by Aurora Bearing Company, Boston Gear Works, as well as others. Steering of the lower frames 12 below the upper lifting frame 14 occurs as the lower frames 12 pivot about ball 84, thus steering the rail axles 18. The tubular member 78, which may pivot about round bars 80, enables the axle 18 to shift from side-to-side to effect a "differential action" of the tapered railroad wheels on the rail tracks. The lower ends of plates 74, 76, when contacted by members 78, serve to limit the sideward shift of the axle.

Steering dampers 96 (FIG. 3) are provided which serve to control any excessive motion of the steering means. Two dampers will be mounted with their centerlines roughly parallel to the longitudinal axis of the retractable intermodal vehicle, one end of the dampers being secured to spaced apart brackets 98 carried by the cross bars 26, the other end being secured to brackets 100 on the lifting frame. While only one of the two dampers for the trailing portion of the vehicle 10 is illustrated, another pair may be used for the leading portion of the vehicle.

Figure 8:
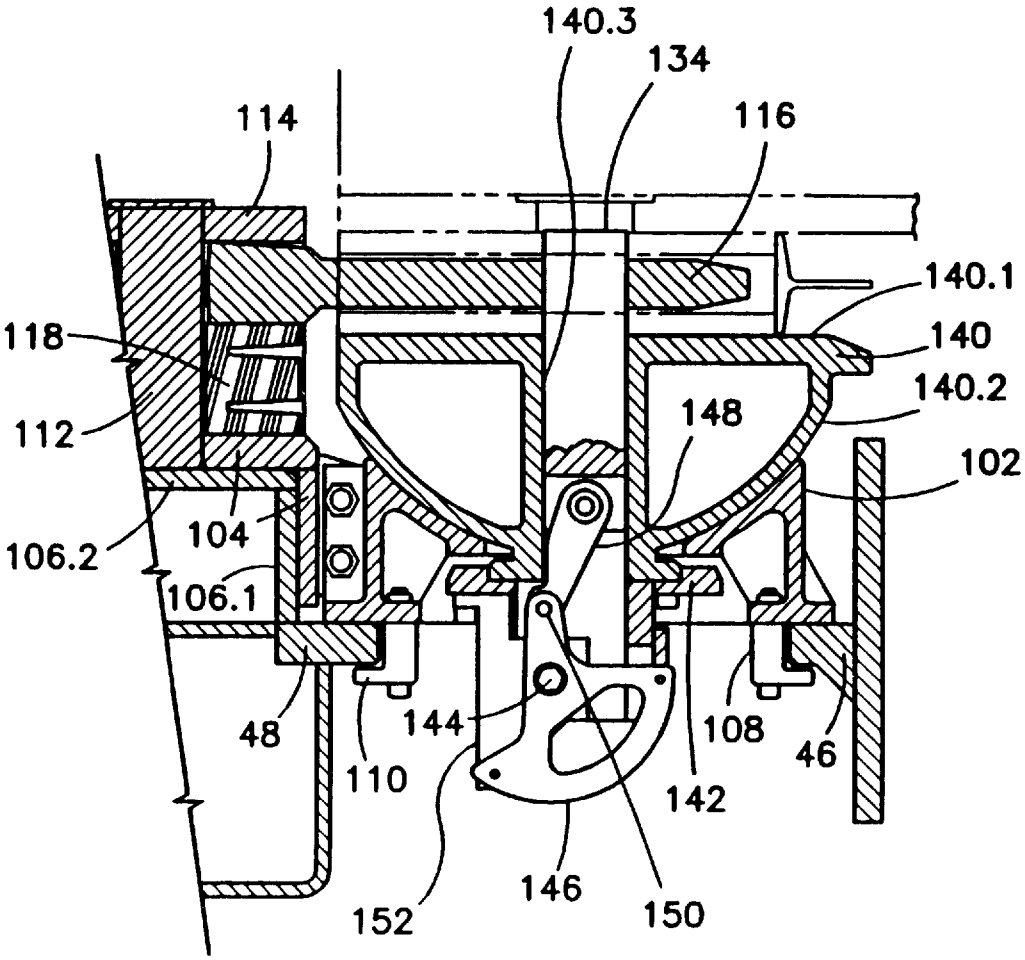
FIG. 8 is an enlarged view of the area indicated at 8 in FIG. 3.

Each of the trailer support heads 16 is mounted for limited side-to-side sliding movement on the associated upper lifting frame 14. To this end, the socket forming structure 102 and coupler body 104, which are bolted together, are slidable supported by cross bars 46, 48 and a three sided box-like structure 106.1–106.3 which is in turn rigidly supported on, which box beam is the trailing box beam 40 of the leading upper lift frame shown in FIGS. 3 and 8, or the leading box beams 38 of the trailing upper lift frame. To retain the members 102 and 104 on the cross bars, retainers 108 and 110 are provided, the retainers being secured to the socket forming structure 102 by bolts (no number.) A shaft 112 extends upwardly from the coupler body 104, the upper end of the shaft projecting through a removable top plate 114 which is in turn secured to the longitudinally extending plates carried on the top of the coupler body 104. Sandwiched between the top plate 114 and the top of the coupler body 104 is a coupler tongue 116 and a specially shaped rubber pad 118 having transversely extending slots (no number). The rubber pad 118 and the coupler tongue 116 have holes through which the shaft 112 passes. The combination of the rubber pad and the tongue have a total height which is slightly more than the space provided between the top surface of the coupler body 104 and the removable upper plate 114 so that when the upper plate is bolted in place, the rubber pad will be slightly compressed. The hole in the coupler tongue 116 is of a slight "hourglass" shape in its vertical cross-section. This shape allows the tongue to rock along both the vertical and longitudinal axes of the intermodal vehicle to accommodate such motions as the train of intermodal trailers, when coupled together, makes as it travels along a railroad track. It will be noted that only a rocking motion can occur in the aforesaid coupler body, while only a swinging motion can occur in the coupler sockets at the ends of the trailers.

Figure 10:
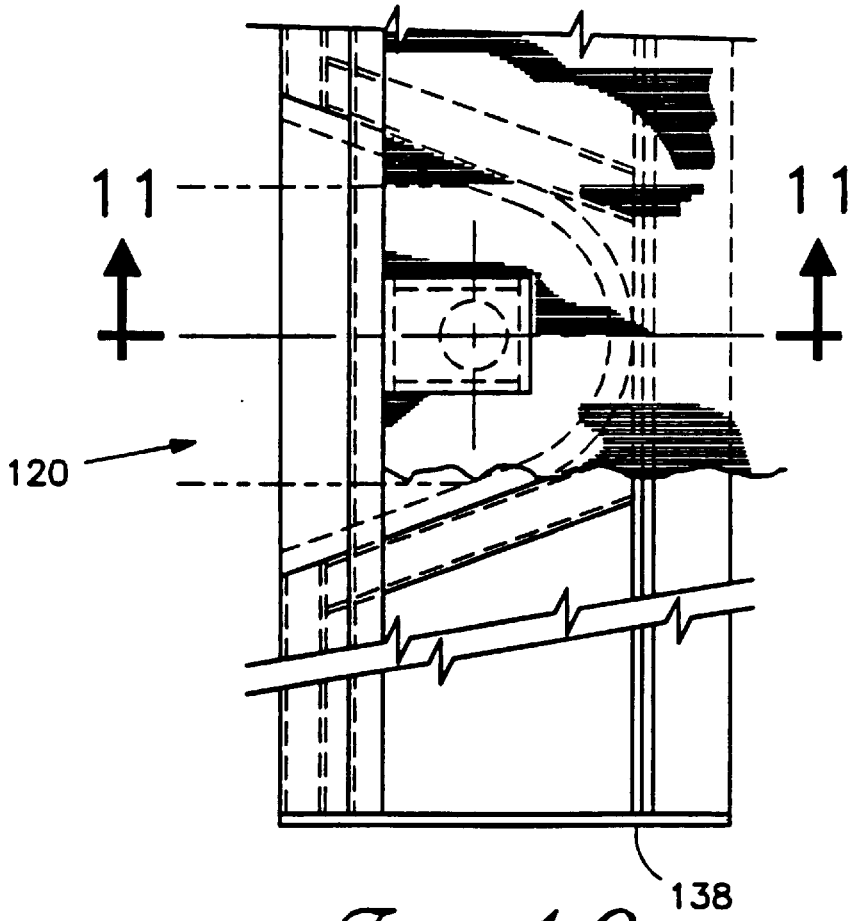
FIG. 10 is a partial plan of the rear end of a trailer of this invention, the socket in the rear end of the trailer being configured to receive an interconnecting tongue which is part of the retractable intermodal vehicle of this invention, the rear end of the trailer being supported by the retractable intermodal vehicle while in use in the rail mode.
Figure 11:
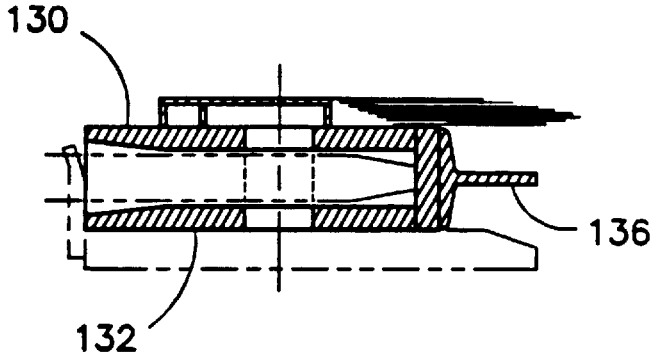
FIG. 11 is a section taken generally along the line 11—11 in FIG. 10.
Figure 12:
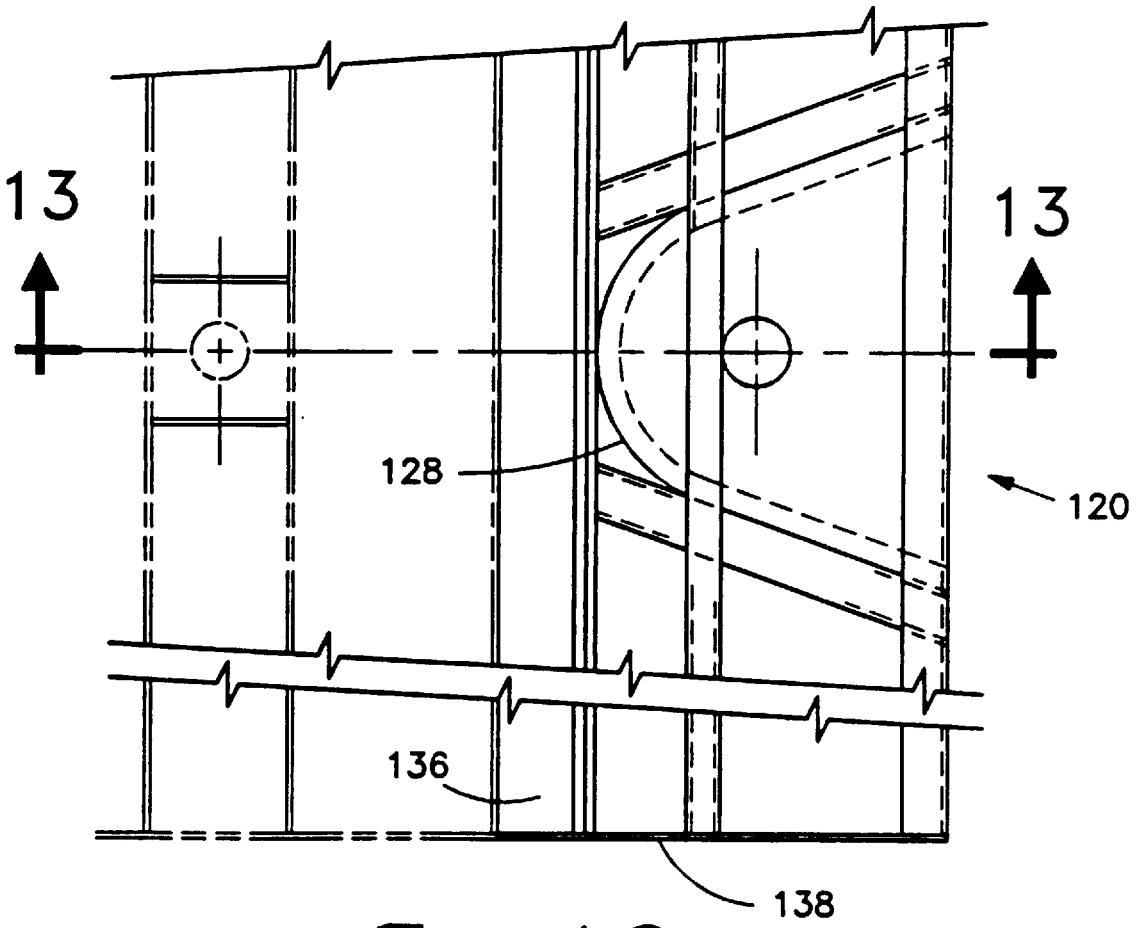
FIG. 12 is a partial plan of the front end of a trailer of this invention, the socket in the front end of the trailer being configured to receive an interconnecting tongue which is part of the retractable intermodal vehicle, the front end of the trailer being supported by the retractable intermodal vehicle when in use in the rail mode.
Figure 13:
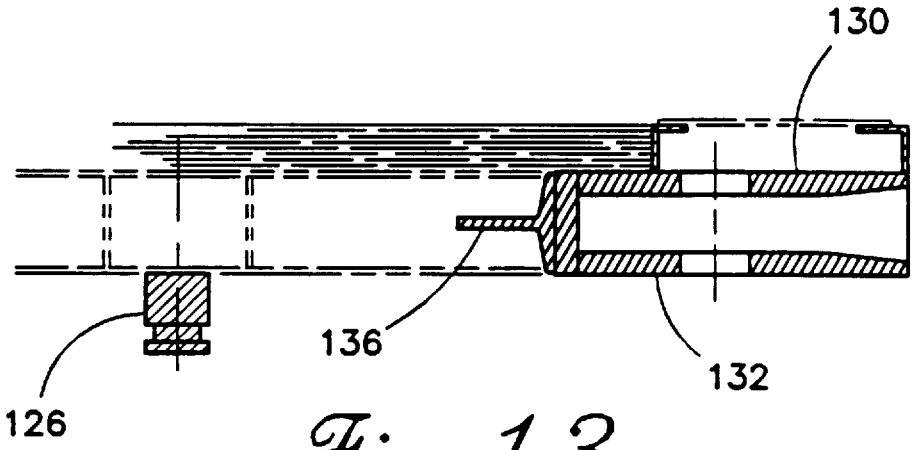
FIG. 13 is a section taken generally along the line 13—13 in FIG. 12.
Figure 15:
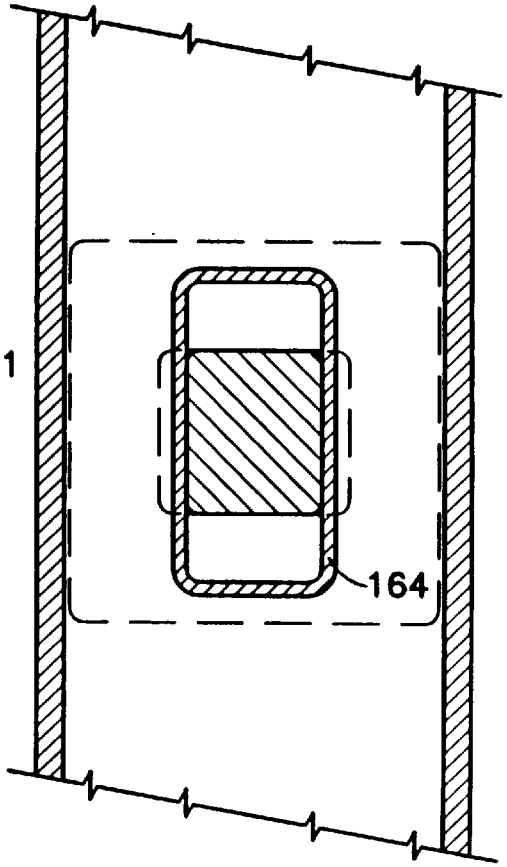
FIG. 15 is a section taken generally along the line 15—15 in FIG. 14.
Figure 16:
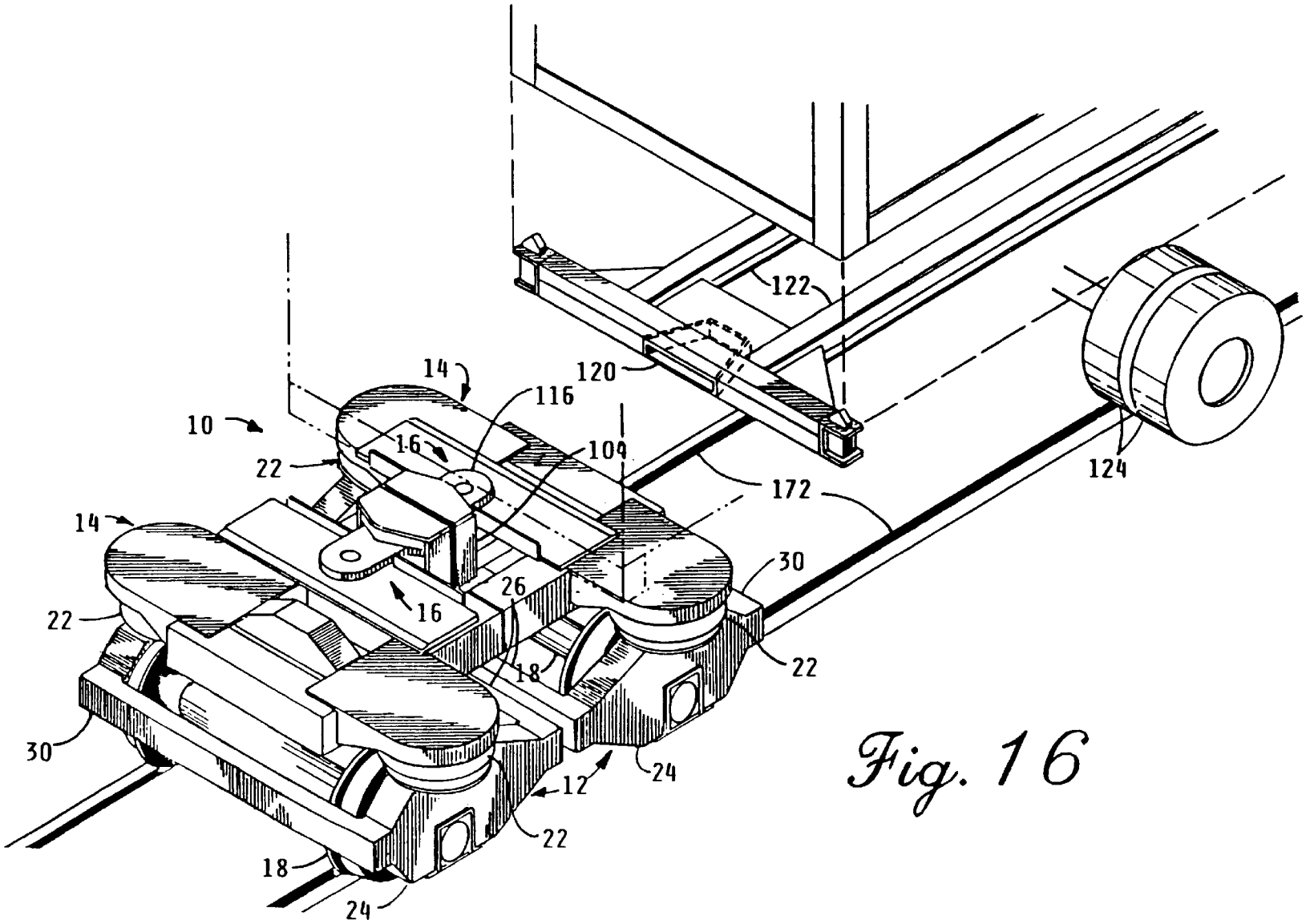
FIG. 16 is a somewhat schematic isometric view of an intermodal vehicle together with the rear end of a trailer, showing the major components of each.

FIGS. 10 and 11 show a coupler socket at the rear of a typical trailer 11 and FIGS. 12 and 13 show a coupler socket at the front of a typical trailer. Coupler sockets 120 are the same for both front and rear of a trailer. The trailer, as shown in FIG. 16, includes a longitudinally extending main frame member 122, a highway wheel assembly including wheels 124. It also includes a fifth wheel king pin 126 behind the front coupler socket 120 as shown in FIG. 13. The trailer socket consists of a side plate 128, flared to allow the coupler tongue to swivel within the coupler assembly, a top plate 130, and a bottom plate 132. Both the top plate and the bottom plate have holes, as does the coupler tongue 116. When the tongue is inserted into the coupler body 120, and all of the holes are co-axial with one another, a movable coupling pin 134 (FIG. 8) will be urged upwardly from the intermodal vehicle, thus effecting a coupling between the intermodal vehicle and the trailer. The coupler body or socket 120 is fastened to the structure of the trailer by transverse beams 136, which are attached to the trailer side structure by plates 138, all as shown in FIGS. 10–13.

Each trailer support head 16 further includes a support plate and bowl 140 having an essentially flat surface 140.1 which may engage the lower surface of a highway trailer and thus supports its weight. The support plate and bowl assembly also has an integral spherically-shaped bowl 140.2, which fits into and rides within socket forming structure 102, and a central aperture 140.3. The support plate and bowl is prevented from coming out of socket 102 by a plate 142. Riding within the central aperture 140.3 is the coupling pin 134. The coupling pin 134 is shown in the "down" position in FIG. 3 and in the "up" position in FIG. 8. The coupler is operated by turning a shaft 144 with a wrench, the shaft being turned so that crank 146 moves link 148 through pivot 150 to raise the coupler pin 134. When the coupler pin is fully raised as in FIG. 8, it passes through the upper and lower walls of the socket in the semi-trailer and through the aperture in the coupling tongue 116. Crank 146 is supported by brackets 152 (FIG. 4) attached to the support plate bowl structure 140 and is held in either the "up" or "down" position by spring pins 154 attached to bracket 152 which enter appropriate detents in the crank 146. Access to the shafts 144 is achieved through tubes 156 which pass through an associated longitudinally extending tube 34, 36, only the leading left hand tube being shown in FIG. 4.

Figure 2:
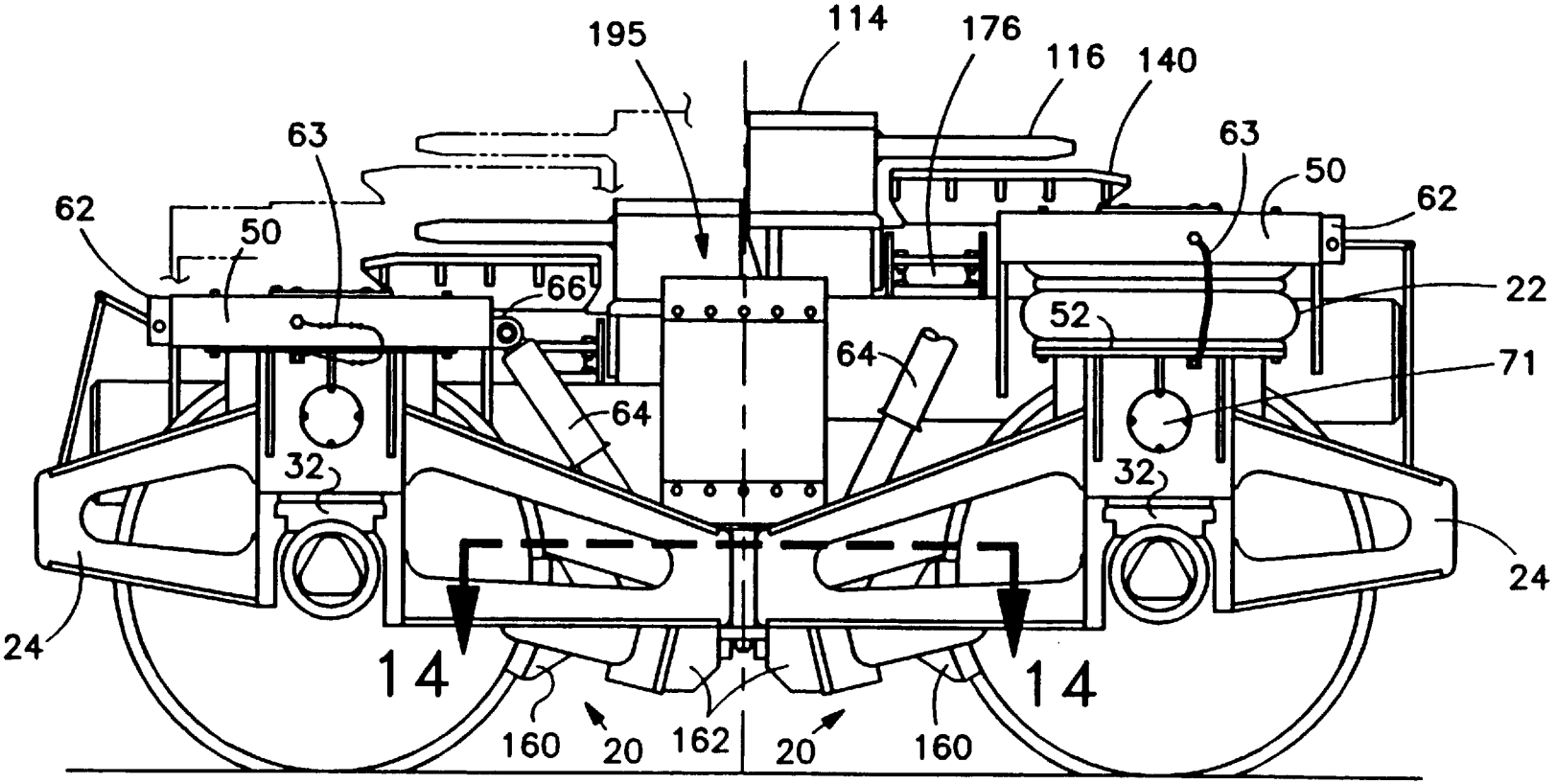
FIG. 2 is a side view of the retractable intermodal vehicle shown in FIG. 1, the portion to the left of the centerline being shown in full lines in the retracted or lowered position, and the portion to the right of the centerline being shown in the raised or extended position.

As shown in FIG. 1, the braking system for the rail truck may consist of brake beams 158 transversely mounted between the side frame assemblies 24, each brake beam having near its outer ends right and left brake shoes 160 (FIG. 2). All of these elements are arranged so that when pressure is applied to the brake beams by means of one or more air cylinders 160 and/or a system of levers, the brake beams will move toward the rail wheels 18 until the brake shoes contact the wheels, the friction of the shoes against the wheels causing the vehicle to slow down and stop.

Figure 3:
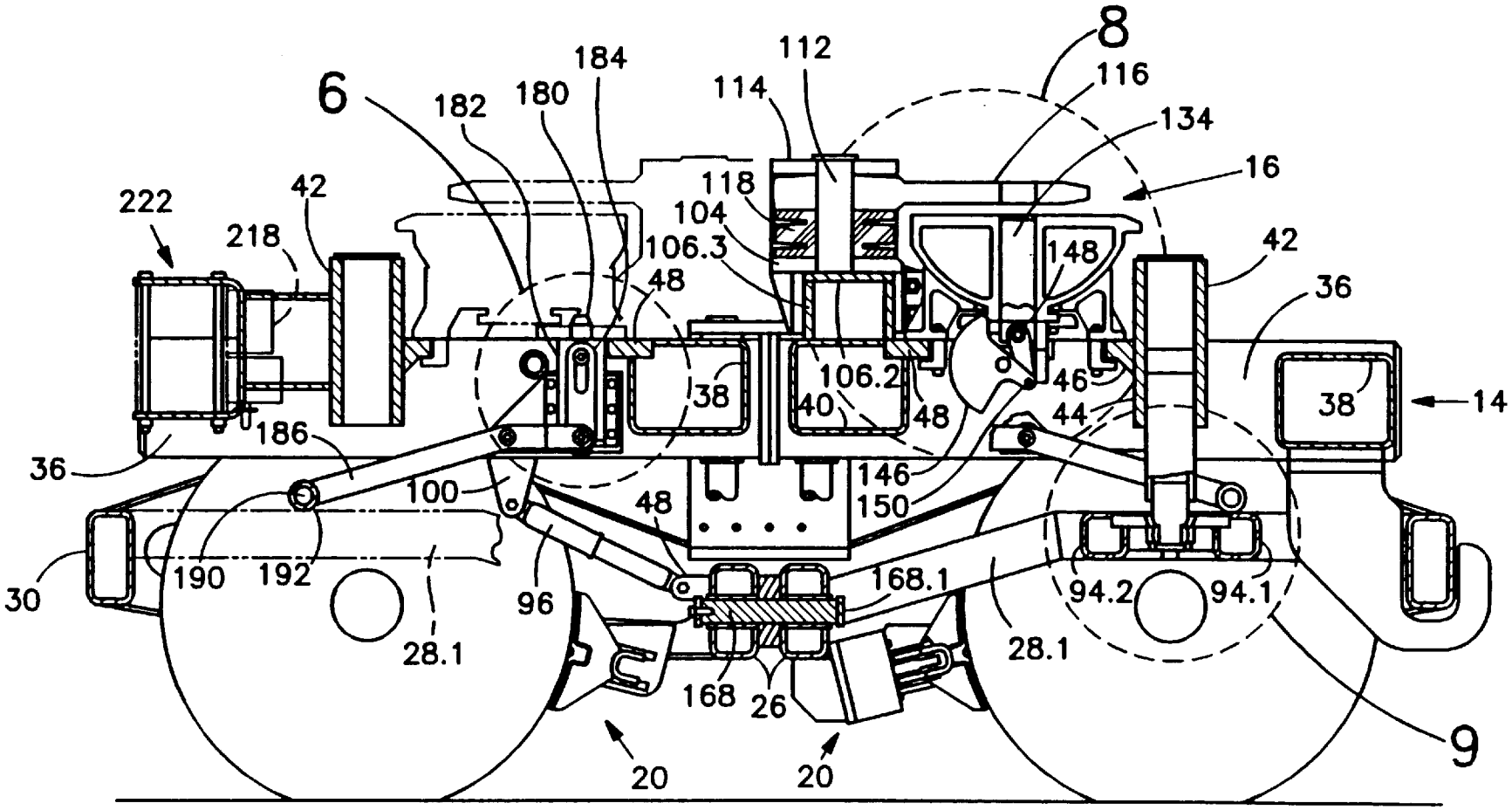
FIG. 3 is a longitudinal section of the retractable intermodal vehicle taken generally along the line 3—3 in FIG. 1
Figure 14:
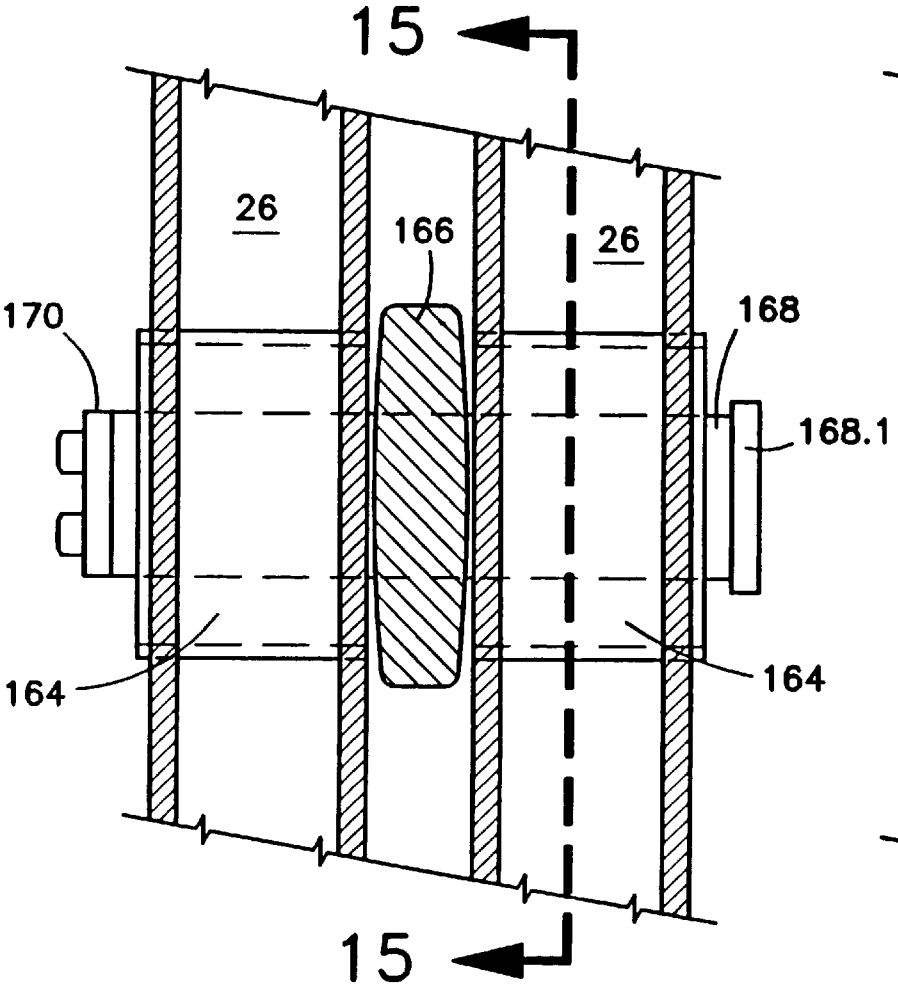
FIG. 14 is a partial sectional view taken generally along the line 14—14 in FIG. 2 showing the structure which counteracts reactive forces when the brakes on the rail truck are applied.

When the brakes are applied, a reaction will occur in the lower frames of the rail truck. Thus, the end of one lower frame will tend to move downward (or upward depending upon the direction of travel of the rail truck when the brakes are applied), while the adjacent end of the other lower frame will move in the opposite direction. Turning now to FIGS. 3 and 14, a means for counteracting the aforesaid reactive (rotational) forces is shown. Thus, cross bars 26 of the individual lower frame assemblies are each provided with longitudinally extending aligned apertures which receive a tube 164, welded thereto. Between the tubes 164 is a guide block 166 which is curved where it meets the surface of the tubes 164, the curve being necessary to prevent binding of tubes 164 against the guide block 166 as the individual lower frame "steer" while the rail truck travels along the tracks. A reaction bar 168 passes through tubes 164 and through guide block 166 at the longitudinal centerline or the rail truck. The width of the reaction bar is less than the width of the aperture so as to allow the adjacent ends of the lower frames to "steer" as described above without binding. One end 168.1 of the reaction bar 168 is enlarged so as to prevent its passage through tubes 164 and a removable plate 170 is fastened to the opposite end for the same purpose.

The procedure for attaching the retractable intermodal vehicle to a mating intermodal trailer is shown in FIG. 16. The retractable intermodal vehicle is placed on the railroad track 172. A trailer is backed over the retracted intermodal vehicle so that the intermodal tongue 116 on the vehicle enters the opening 120 in either end of a trailer and the transverse plate 140.1 supports the trailer at its lower surface. It should be noted that the coupling socket into which the coupler tongues enter are the same at both the front and the rear of the trailer, so that it makes no difference whether the front or the rear of any trailer within a train of these trailers travels forward or rearward with relationship to the direction of train travel.

It has been previously mentioned in the specification that in order to make it easier for the tractor/trailer driver to locate the rear of the trailer upon the upper lifting frame 14, the trailer support plate 140 and the coupler tongue assembly 116 can move from side to side. When the upper lifting frame with the superimposed trailer is raised to rail operating height, a means must be provided to hold the trailer support plate and coupler tongue in a fixed position along the centerline of the rail truck.

Figure 4:
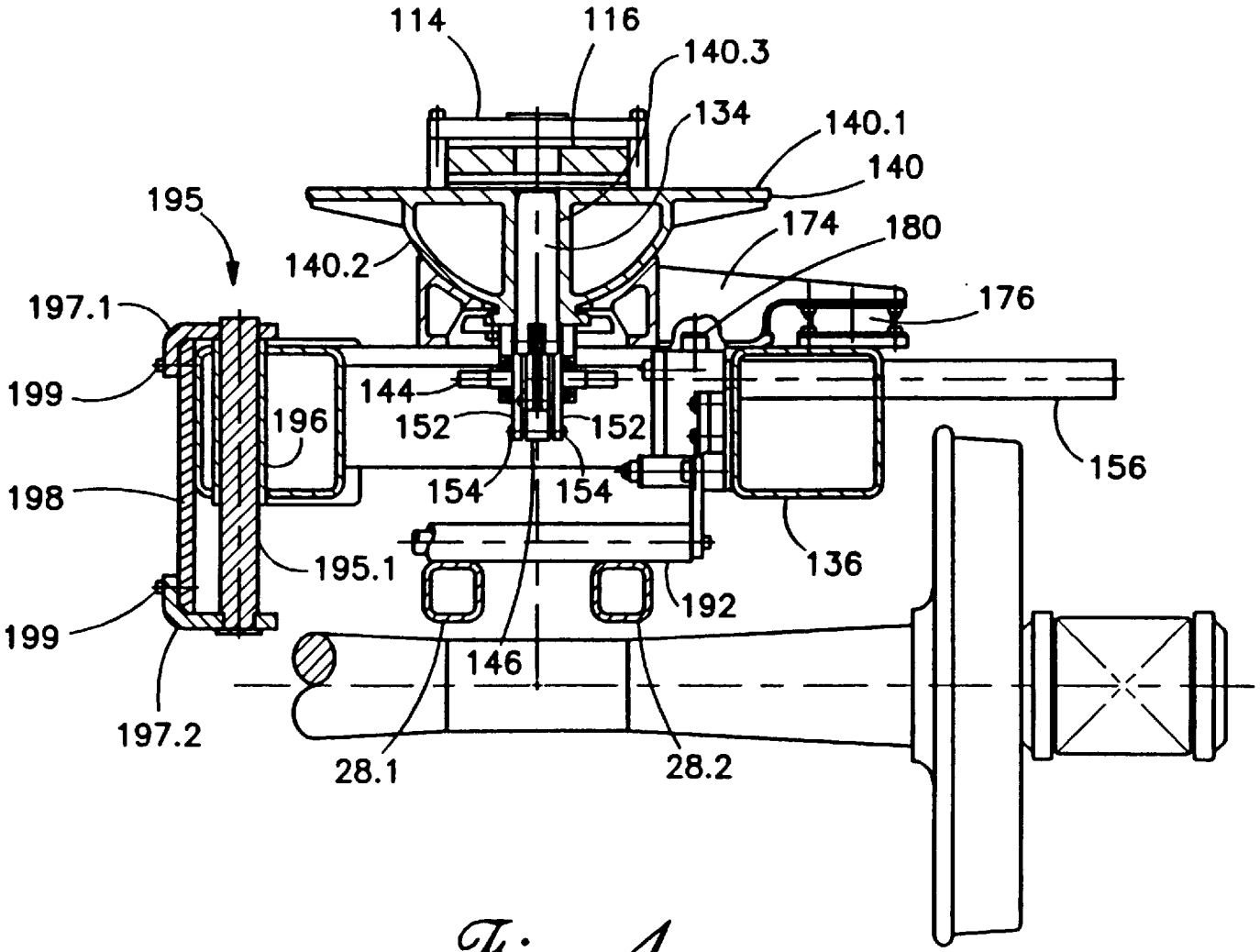
FIG. 4 is a cross-section view of the retractable intermodal vehicle taken along the line 4—4 in FIG. 1, parts being eliminated for purposes of clarity.

FIG. 4 is a cross-section of the rail truck taken at the center of the trailer support. As previously noted, the socket 102 rests upon bars 46 and 48 and can slide from side to side. Referring also to FIG. 1, brackets 174 attached at both sides of socket 102 provide the upper mountings for shear springs 176, the lower portions of which are fastened to the frame 34, 36 of the upper frame 14. Bracket 174 also incorporates holes 178 (one of which is shown in FIG. 1) into which locking pins 180 enter to prevent side-to-side movement of the socket 102 when the upper lifting frame 14 of the rail truck 10 is raised.

Figure 6:
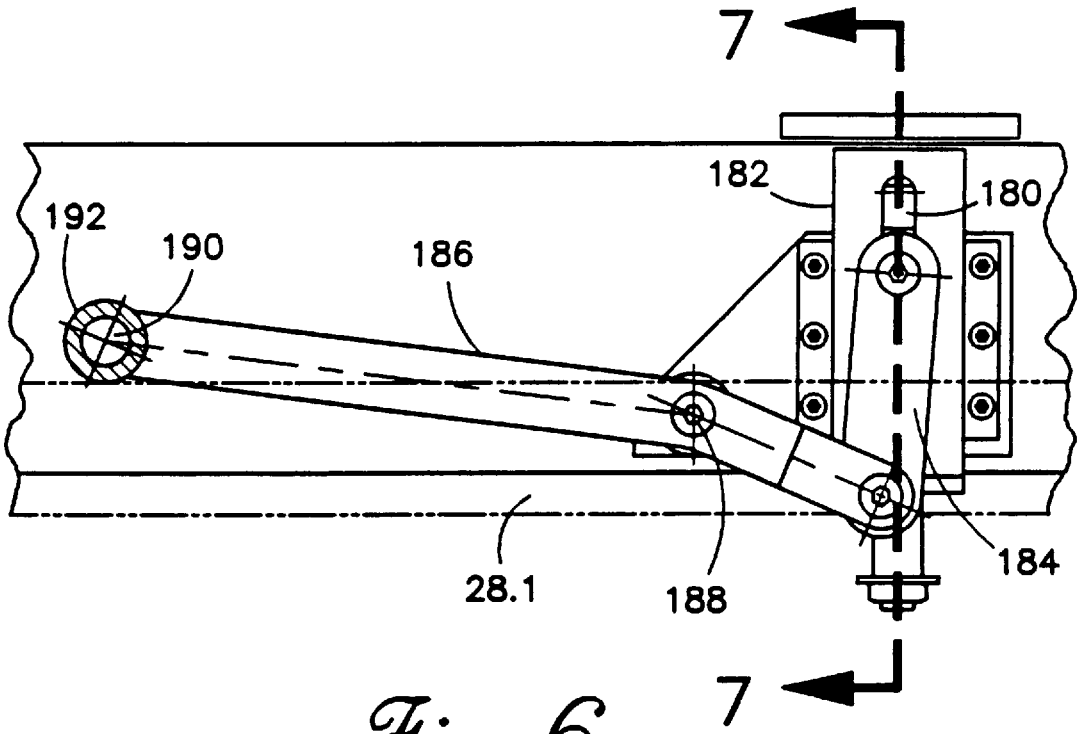
FIG. 6 is an enlarged view of the area indicated at 6 in FIG. 3.
Figure 7:
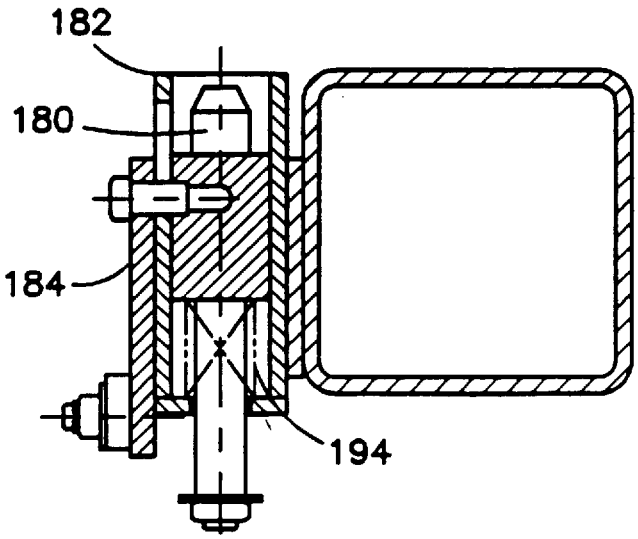
FIG. 7 is a section taken generally along the line 7—7 in FIG. 6.

FIG. 3 shows the locking pin 180 in the raised position with the pin 180 entered into hole 178 in the bracket 174. FIGS. 6 and 7 show the locking pin in the lowered position, not entered into the hole in the bracket and thus allowing the socket 102 to slide from side to side.

Shear springs 176, as previously mentioned, are mounted between the bracket 174 and the longitudinal tubes 34, 36. These springs, which are in the "neutral" position when the bowl 102 is centered in the rail truck, are able to flex or "shear" when the bowl moves during the trailer coupling operation. The shear springs, having a tendency to seek their neutral position, serve to urge the bowl to the center of the rail truck where it is locked by the aforesaid locking pins after the trailer coupling operation.

FIG. 7 shows pin 180 enclosed in housing 182 activated by link 184 operated by lever 186, pivoted on fixed pivot 188, the lever being one of two at opposite sides of the rail truck frame and connected by transverse shaft 190 upon which roller 192 turns. Roller 192 operates against the longitudinally extending tube 28.1 (or 28.2) of the steering arm assembly. Thus, when the upper lifting frame 14 is in the lowered position, levers 186 cause link 184 to pull the pin 180 downward within housing 182. Spring 194 below the pin 180 serves to urge the pin upward when roller 192 is in the lowered position as seen in FIG. 3.

The two upper lifting frames 14 are fastened together by a pair of sliding joint assemblies 195, each of which includes two vertical tubes 196 welded to associated tubes 34, 36 as can be seen from FIG. 4, and two shafts 195.1. The joint assembly further includes an upper plate 197.1 welded to the top end of shafts 195.1, and a removable lower plate 197.2. The upper and lower plates of each joint assembly 195 are connected together by a side plate 198. The plates are secured to one another by cap screws 199. The sliding joint assemblies will maintain proper alignment between the leading and trailing upper frames, even when one is up and the other is down.

Figure 17:
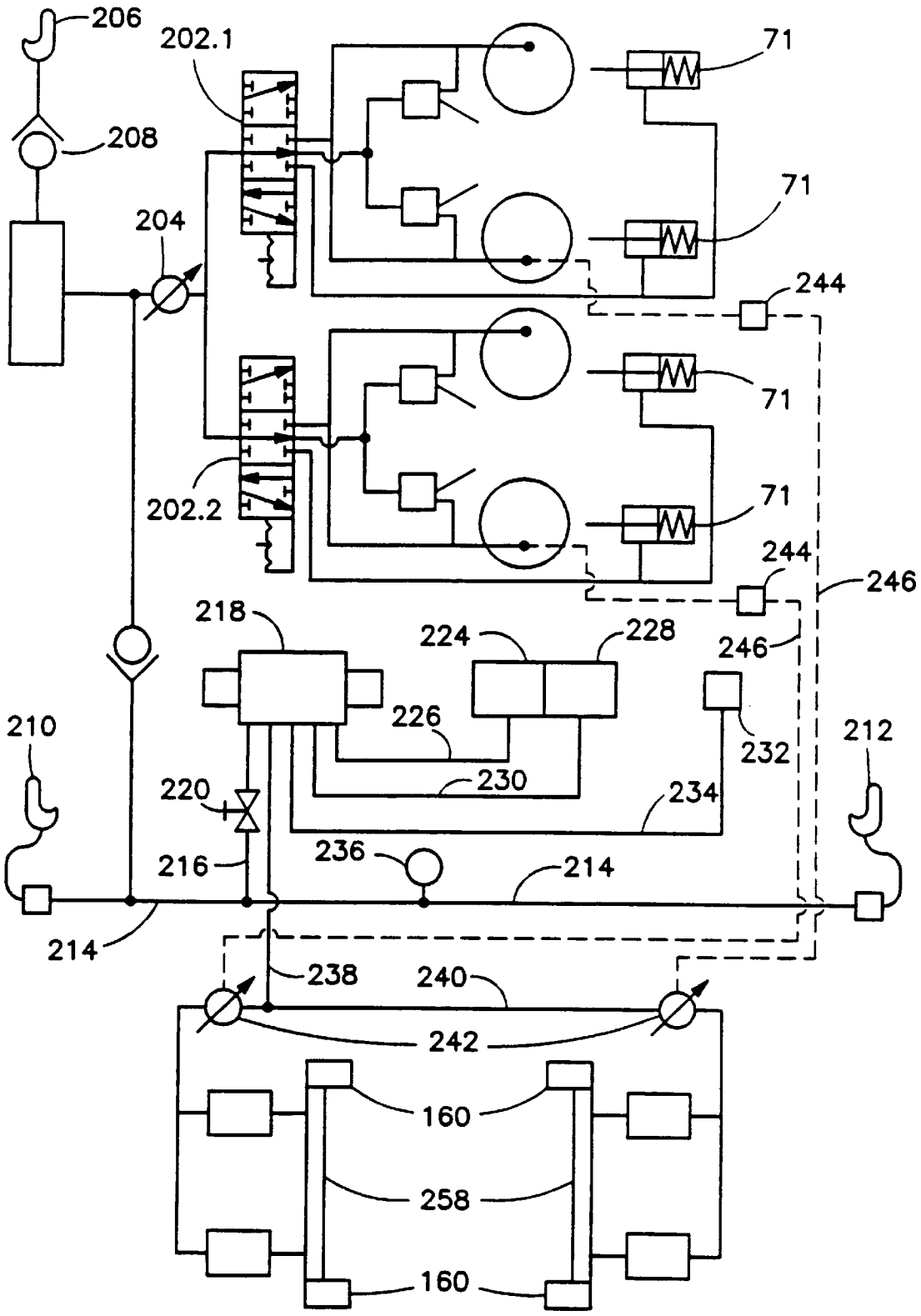
FIG. 17 is a schematic diagram of the retractable intermodal vehicle air suspension/lift arrangement and the air brake system.

FIG. 17 shows the schematic diagram for the air suspension/lift arrangement and the air brake system of the retractable intermodal vehicle of the invention. An on-board air reservoir 200 (formed by the tubes 34–40 on the leading upper lift frame 14) supplies air to the air springs 22 through control valves 202, their being a control valve 202.1 for springs 22 which support the leading upper lifting frame 14, and a control valve 202.2 for the springs which support the trailing upper lifting frame. The air pressure to the valves 202 is controlled by regulator 204. Each of the control valves 202 has three positions. The valves are preferably spring centered and may be manually moved to either extreme position. Each of the valves may be operated in any suitable manner. For rapid filling of the air spring, the valves will be in a first position permitting flow from the reservoir directly to the air springs 22. During this operation, air from the reservoir will be replenished from an external source of compressed air (a yard hostler tractor, for example) supplied through a quick connect coupling or glad hand 206 and check valve 208. During rail operation, the control valve 202 will be in the centered or intermediate position shown in FIG. 17 where it will direct air from the reservoir 200 through height control valves 62. As previously discussed, each air spring 22 has within it an internal strut 54 which serves to guide the spring up or down. The housing in which this strut slides is fitted with a spring loaded safety stop 70. (These elements are better shown in FIG. 5). This safety stop is held in an extended position about 2.5 cm (one inch) below the bottom of the sliding strut by a coil spring and has the purpose of preventing the complete downward movement of the strut in the event of a failure of the air spring. When the retraction of the associated upper lifting frame is necessary (for the removal of the superimposed semi-trailer), the control valve 202 will be placed in the third position, in which position cylinder 71 will retract the aforesaid safety stop and air will simultaneously be evacuated from the air springs.

The brake system is a standard arrangement as is customary in the rail industry, as shown in WABCO manual number 5062-18 and includes the elements set forth below. Glad hands 210, 212 connected to hoses feed train line 214. Pipe 216 feeds ABDW brake control valve 218 through cock 220. The valve 218 is mounted to the rear of the trailing upper lifting frame 14 by a conventional mounting assembly indicated generally at 222 in FIG. 3. The valve 218 is connected to control valve from emergency air reservoir 224 via line 226, auxiliary air reservoir 228 via line 230, and retaining valve via retaining valve line 234, respectively. The reservoirs 224 and 228 are formed in the beams 34–38 of the trailing upper lifting frame, the transverse member being provided with an aperture where one of the beams 34, 36 is welded, but not where the other beam is welded. A relay valve 236 may be connected to line 214. Line 238 from control valve 218 feeds distribution pipe 240 which supplies air to brake cylinders 162 through pilot operated air regulators 242. The pressure sensors 244 on air springs 22 acting through pilot lines 246 cause regulators 242 to increase or decrease air pressure to brake cylinders 162 in proportion to the superimposed load on the air springs, thus effecting a rudimentary load sensing brake control system. Thus, when the associated axle/wheel assembly is heavily laden, more braking force will be applied than when lightly laded.

Figure 19:
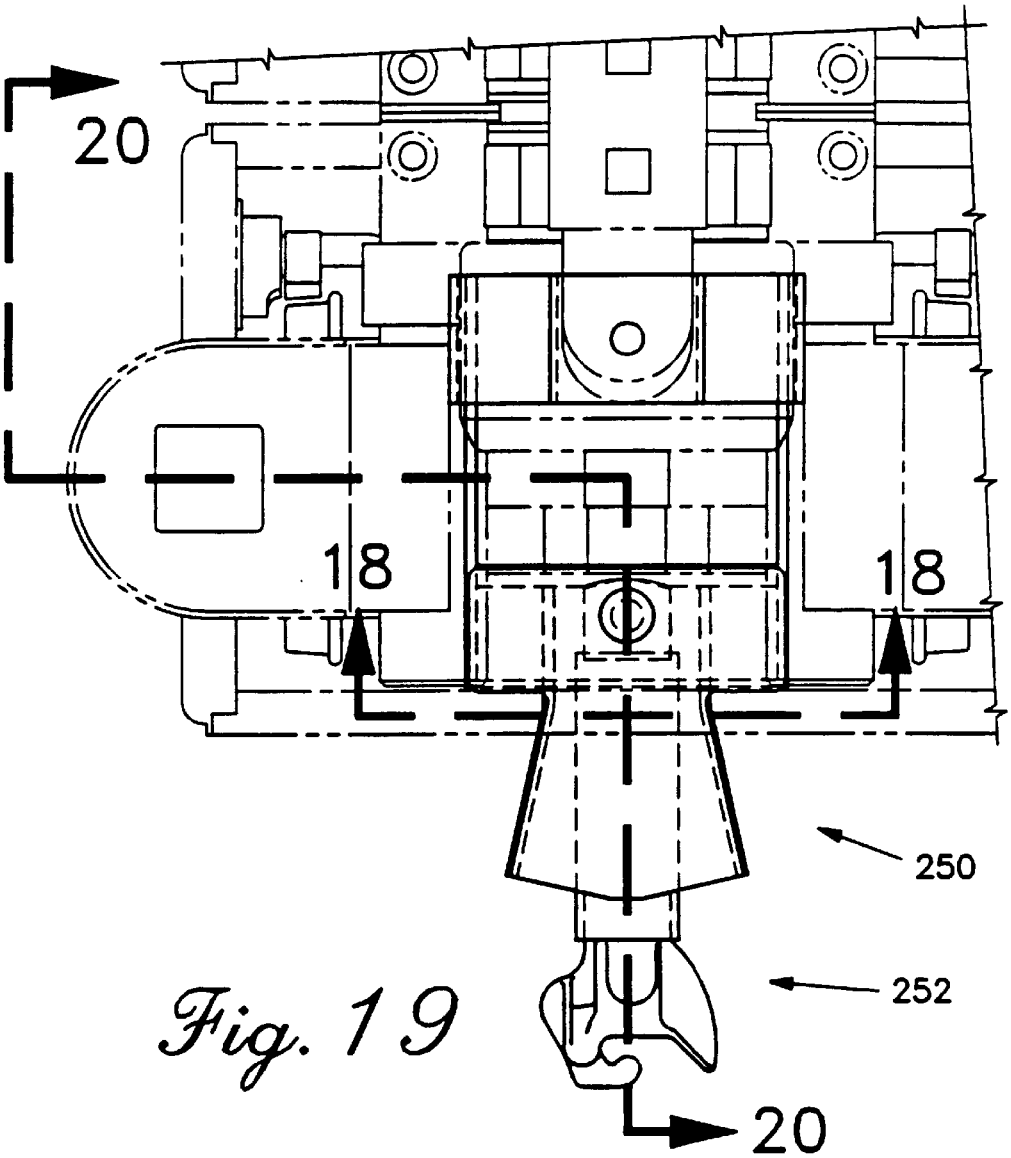
FIGS. 18 and 19 are a sectional view and a plan view of a coupler adapter secured to one of the coupler assemblies shown in FIG. 1, lower portions of the retractable intermodal vehicle being shown in phantom lines, FIG. 18 being a section taken generally along the line 18—18 in FIG. 19.
Figure 20:
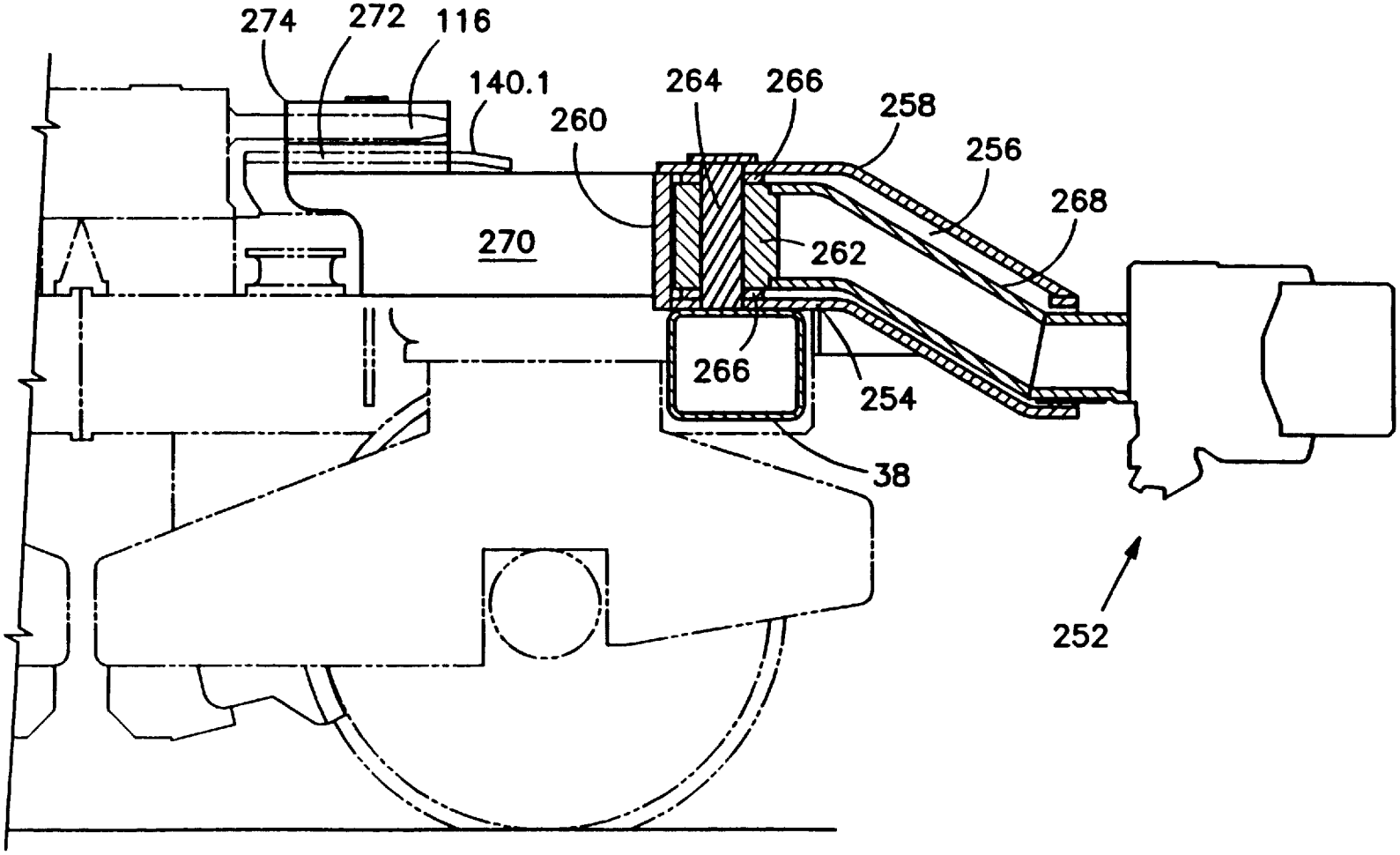
FIG. 20 is a side view, partially in section, of the coupler adaptor shown in FIG. 17.

Since it will be necessary for the rail trucks of this invention to operate with and connect to couplers of differing configurations, it is necessary that a transition assembly be provided that will permit this connection. The following description deals with a transition assembly which can adapt the unique coupler means of the present invention to a standard knuckle-type railroad coupler such as found on railroads in North America. However, it is not the intent to limit this transition assembly to only one type of existing coupler, since it is obvious that by removing the knuckle coupler and substituting elements of a different configuration other railroad couplers and couplers of competing intermodal systems can also be adopted for use with the present invention. FIG. 19 shows a plan view and FIGS. 18 and 20 show sections of a transition assembly of the present invention which makes the transition from one coupler system to another as described above.

The transition assembly is indicated generally at 250 and, as illustrated, it can be connected to a knuckle coupler, indicated generally at 252. The transition assembly has a forward box-like structure which includes a lower plate 254 which is adapted to rest upon an upper surface of a transversely extending beam 38, side members 256, and an upper member 258. The rear ends of the lower plate 254, side members 256 and upper member 258 are welded to a transversely extending plate 260. The lower plate, side members, and upper member all extend forwardly and downwardly are flared in the manner indicated in the drawings. A swivel block 262 is carried by a pivot pin 264 which passes through suitable apertures in the lower and upper plates 254 and 258, the bearing block or swivel block 262 being spaced away from adjacent surfaces of the lower and upper plates 254 and 258 by spacers 266. A downwardly and forwardly extending tubular structure 268 is rigidly secured to the swivel block 262 and is permitted limited swinging movement as can be seen from an inspection of FIG. 19. The forward end of the tubular structure 268 has the knuckle coupler 252 welded or otherwise rigidly secured thereto.

Figure 18:
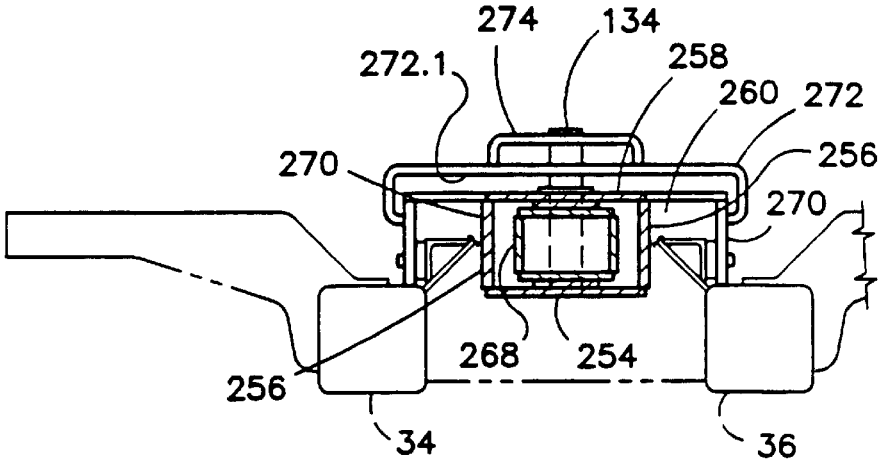

A pair of longitudinal rearwardly extending side plates 270 are welded to the rear of plate 260, the lower surface of the side plates 270 resting upon the top surface of the longitudinally extending tubes 34, 36 when the transition member is mounted upon a truck 10 as can best be seen from FIG. 18. As saddle structure 272 is carried by the rear portion of the side plates 270 and the lower surface 272.1 and is adapted to rest upon the top surface 140.1 of the support plate and bowl 140. A further saddle 274 is carried by the first saddle structure and the coupler tongue 116 and is adapted to pass though the saddle 274. The saddles are rigidly secured to the coupler and plate by causing the coupling pin 134 to be extended upwardly through suitable apertures in saddles 272 and 274 as well as through the coupler tongue 116.

While a preferred form of this invention has been described above and shown in the accompanying drawings, it should be understood that the applicant does not intend to be limited to the particular details described above and illustrated in the accompanying drawings. For example, while two separate upper lifting frames have been disclosed in the various figures, under some circumstances a single frame may be desired. Instead of using a linkage to raise and lower the coupling pin 134, an air cylinder or other powered device may be used. Other variations will occur to those having ordinary skill in the art. Therefore applicant intends to be limited only to the scope of the invention as defined by the following claims. In addition, it also makes no difference if the retractable intermodal vehicle moves in either a forward or rearward direction. Therefore, it should be understood that the terms leading and trailing have been used for convenience only and are not intended to be limiting in any respect.

What is claimed is:

1. A train comprising:

a plurality of highway trailers, each of the highway trailers including at least one highway wheel assembly, and a main frame interconnected with said at least one highway wheel assembly, the main frame being provided with fore and aft extending leading and trailing coupler sockets at each end, each coupler socket having an aperture; and a plurality of intermodal vehicles, each intermodal vehicle including two rail wheel assemblies, lower frame means in which the two rail wheel assemblies are mounted, upper lifting frame means supported on the lower frame means, leading and trailing gravity load carrying structures supported on the upper lifting frame means for engaging the bottom of the leading and trailing highway trailers, respectively, a vertically oriented coupling pin carried by each of the gravity load carrying structures, fore and aft extending leading and trailing centrally located coupler tongues having first and second ends, the first ends of the leading and trailing coupler tongues being interconnected with the leading and trailing load carrying structures, respectively, and the second ends of the leading and trailing coupler tongues being apertured and received within the coupler sockets of the highway trailers, each of said coupler tongues receiving an associated coupling pin, and means to move the associated coupling pin vertically from a position below a trailer resting surface of the load carrying structures to a raised position through said aperture of the respective coupler tongue and said aperture in said coupling socket, thereby providing a coupling between the coupler tongue, the socket and the load carrying structure.

2. The intermodal vehicle as set forth in claim 1 wherein each of the coupler sockets has a pair of aligned spaced apart upper and lower apertures, the respective coupler tongue passing between said upper and lower apertures.

3. The train as set forth in claim 1 wherein the upper lifting frame means is supported on the lower frame means for vertical movement, wherein raising and lowering means are provided between the lower frame means and the upper lifting frame means for causing the upper lifting frame means to be raised and lowered with respect to the lower frame means; the first ends of the coupler tongues being shiftable from side-to-side to facilitate connection of the coupler tongues to the sockets.

4. The train as set forth in claim 3 further characterized by the upper lifting frame means being shiftable from side-to-side relative to the lower frame means, the lower frame means being separate steerable leading and trailing frames which are pivotally connected to the upper lifting frame means, and wherein the raising and lowering means are air springs, the air springs providing a restoring force during steering.

5. An intermodal vehicle for use in forming a train of highway trailers including leading and trailing highway trailers which are interconnected to each other and supported by the intermodal vehicle for travel upon railroad tracks, each of the highway trailers including leading and trailing highway coupler sockets at each end, the coupler sockets having vertically aligned apertures; said intermodal vehicle comprising:

two rail wheel assemblies;

lower frame means in which the two rail wheel assemblies are mounted;

upper lifting frame means supported on the lower frame means;

leading and trailing upwardly presented gravity load carrying structures supported on the upper lifting frame means for engaging the bottom of the trailing and leading highway trailers, respectively;

leading and trailing coupler tongues carried by the upper lifting frame means, a portion of each coupler tongue capable of being received in an associated one of said coupler sockets, said portion of each of the coupler tongues having a vertically extending aperture;

leading and trailing vertically oriented coupling pins carried by the upper lifting frame means; and coupling pin lifting means for moving each coupling pin in a vertical direction from a position below a trailer resting surface of the load carrying structure to a raised position through vertically aligned apertures in an associated an associated one of said highway trailer coupler sockets and said aperture in said portion of a coupler tongue to effect a coupling between the coupler tongue of the intermodal vehicle, the load carrying structure, and the coupler socket of the highway trailer resting upon the load carrying structure.

6. The intermodal vehicle according to claim 5 wherein the upper lifting frame means is supported on the lower frame means for vertical movement by spring means.

7. The intermodal vehicle according to claim 5 wherein the leading and trailing vertically oriented coupling pins are carried by the leading and trailing gravity load carrying structures, respectively.

8. The intermodal vehicle according to claim 5, wherein each coupler tongue is supported by yieldable means yieldable in all directions so that the coupler tongue has limited pivotal, rolling and pitching movement without carrying gravity load.

9. The intermodal vehicle as set forth in claim 6, wherein the spring means are air springs arranged so that when the air is removed from the air springs, the upper lifting frame means will descend towards the lower frame means and when air is introduced into the air springs, the upper lifting frame means will rise, at the same time raising any highway trailers which may be resting upon the load carrying structures.

10. The intermodal vehicle as set forth in any one of claims 5 to 9 further characterized by the lower frame means of the intermodal vehicle being separate steerable leading and trailing lower frames which are pivotally interconnected to the upper lifting frame means at the intersection of the intermodal vehicle centerline with the respective centerlines of the rail wheel assemblies.

11. The intermodal vehicle as set forth in claim 10 wherein a pivot assembly for each of the lower frames is fastened at its top to the upper lifting frame means of the intermodal vehicle and at its bottom to a part of an associated said lower frame, each pivot assembly being constructed so it may telescope within itself when the upper lifting frame means of the intermodal vehicle rises or descends, and each pivot assembly further having at its lower end a ball-type universal joint.

12. The intermodal vehicle as set forth in claim 9 further characterized by each intermodal vehicle being provided with restraining cables or chain means extending between the lower frame means and the upper lifting frame means, the cables or chain means acting to limit the maximum upward movement of the upper lifting frame means under the influence of the air springs.

13. The intermodal vehicle as set forth in claim 9, wherein the intermodal vehicle has an integrally-mounted braking system which is load sensitive via a load signal received from the air springs.

14. The intermodal vehicle as set forth in claim 9, further characterized by portions of the upper lifting frame means of the intermodal vehicle being hollow and used as reservoirs for compressed air, the compressed air being used in the operation of the intermodal vehicle for braking and for the supply of air to the air springs.

15. The intermodal vehicle as set forth in claim 9, further characterized by the intermodal vehicle being fitted with height control valves which add or remove air to or from the air springs as required to maintain a preset ride height of the intermodal vehicle.

16. The intermodal vehicle as set forth in claim 6 wherein the intermodal vehicle has strut means comprising a first member and a second member which guides the spring means.

17. The intermodal vehicle as set forth in claim 5 wherein each of the leading and trailing gravity load carrying structures of the intermodal vehicle is mounted in seats attached to the upper lifting frame means of the intermodal vehicle, and in that transverse support bars are provided, each of the seats and coupler tongues being supported on the bars so as to afford them an ability to shift from side-to-side perpendicular to the longitudinal centerline of the intermodal vehicle, the shifting ability facilitating the alignment of the trailer as it is backed over the intermodal vehicle for attachment thereto.

18. The intermodal vehicle as set forth in claim 17 further characterized by the seats being urged to a central or neutral position atop the upper lifting frame means of the intermodal vehicle by springs.

19. The intermodal vehicle as set forth in claim 5 wherein the coupling pin is operated up or down by a mechanical or pneumatic lifting means.

20. The intermodal vehicle as set forth in claim 19 wherein each coupling pin is prevented from dropping by spring loaded pins acting within mating detents within the coupling pin lifting means.

21. An intermodal vehicle for use in forming a train of highway trailers including novel leading and trailing highway trailers which are interconnected to each other and supported by the intermodal vehicles for travel upon railroad tracks; each intermodal vehicle having two rail wheel assemblies;

lower frame means in which the two rail wheel assemblies are mounted;

upper lifting frame means supported on the lower frame means for vertical movement;

raising and lowering means between the lower frame means and the upper lifting frame means for causing the upper lifting frame means to be raised and lowered with respect to the lower frame means; and leading and trailing upwardly presented gravity load carrying structures supported on the upper lifting frame means for engaging the trailing and leading highway trailers, respectively;

the intermodal vehicle being characterized by the raising and lowering means being air springs;

air operated brakes associated with the rail wheel assemblies;

a reservoir carried by each intermodal vehicle for the air operated brakes;

line means extending between the reservoir and the air operated brakes; and air regulators disposed in the line means and interconnected with the air springs for regulating the pressure delivered to the air operated brakes so the delivered pressure is in proportion to the superimposed load on the air springs, thus affecting a rudimentary load sensing brake control system.

22. A transition assembly adapted to interconnect an intermodal vehicle to a coupler of another vehicle, the intermodal vehicle having a leading coupler tongue and support structure providing an upwardly facing support surface, the transition assembly being characterized by a mounting frame including a saddle adapted to receive the coupler tongue therein, and a support interconnected with the saddle and which may rest upon the support surface of the intermodal vehicle, the mounting frame further including a pivot pin interconnected with the support, the transition assembly further including a fore-and-aft extending tubular structure the rear end of which is pivotally connected to the pivot pin, and a railway draft coupler connected to the front end of the tubular structure.

* * * * *